United States Patent [19]

Williams

[11] 4,227,655

[45] Oct. 14, 1980

[54] ROTARY FOOD PROCESSING TOOL HAVING OFFSET HUB

[75] Inventor: James E. Williams, Stamford, Conn.

[73] Assignee: Wilson Research & Development Inc., Greenwich, Conn.

[21] Appl. No.: 37,912

[22] Filed: May 9, 1979

[51] Int. Cl.[3] ..... B02C 18/18

[52] U.S. Cl. ..... 241/92; 83/355; 241/273.2; 241/292

[58] Field of Search ..... 241/92, 199.12, 273.1, 241/273.2, 282.1, 282.2, 292, 298; 83/355

[56] References Cited

U.S. PATENT DOCUMENTS

| | | | |
|---|---|---|---|
| 3,085,607 | 4/1963 | Schottle | 241/92 |
| 3,892,365 | 7/1975 | Verdun | 241/92 |
| 3,985,304 | 10/1976 | Sontheimer | 241/92 |
| 4,127,342 | 11/1978 | Loggiola | 241/92 X |

*Primary Examiner*—Howard N. Goldberg

*Attorney, Agent, or Firm*—Parmelee, Johnson, Bollinger & Bramblett

[57] ABSTRACT

A rotary food processing tool is provided for use in a food processor of the type including a housing containing an electric motor drive, a bowl mountable on the housing for enclosing the tool, said tool being rotated by said motor drive, and a removable cover on the bowl with a feed tube for feeding food items onto the rotating tool and into the bowl. The rotary tool has an elongated hub with a head on one end and coupling means adapted to be coupled to the electric motor drive. The head of the hub is offset from the coupling means such that it revolves around the axis of rotation of the coupling means. The tool includes a horizontal disc-like member mounted on the hub head at a location radially offset from the center axis of the disc-like member. Cutting means on the disc member extends from near the axis to the periphery. Accordingly, the cutting means, which may be a slicing blade or other cutting implements, extends for substantially the entire radius of the disc member contrasting with prior art tools whierein the hub is central and, therefore, prior cutting means can extend for only part of the radius, providing a significantly shorter cutting surface and smaller cutting capacity. The novel cutting surface extending for substantially a full radius of the disc member permits processing of larger food items and accommodates use of feed tubes of larger radial width for feeding larger food items.

18 Claims, 6 Drawing Figures

Fig. 1.
(PRIOR ART)
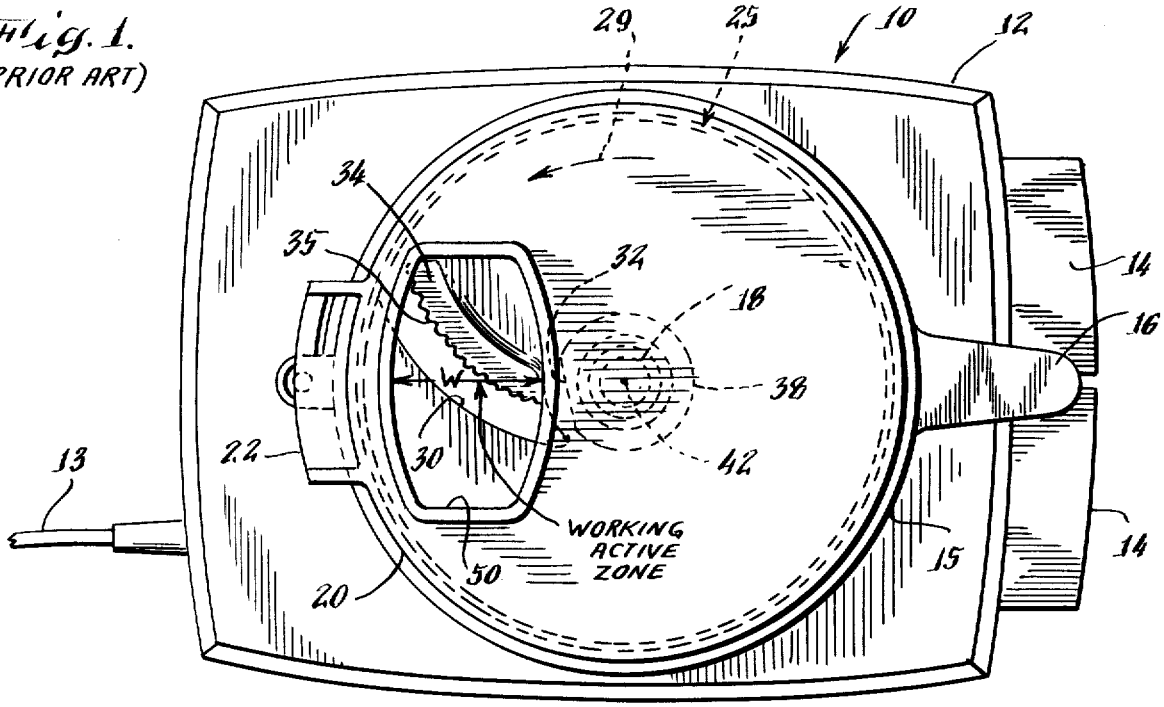
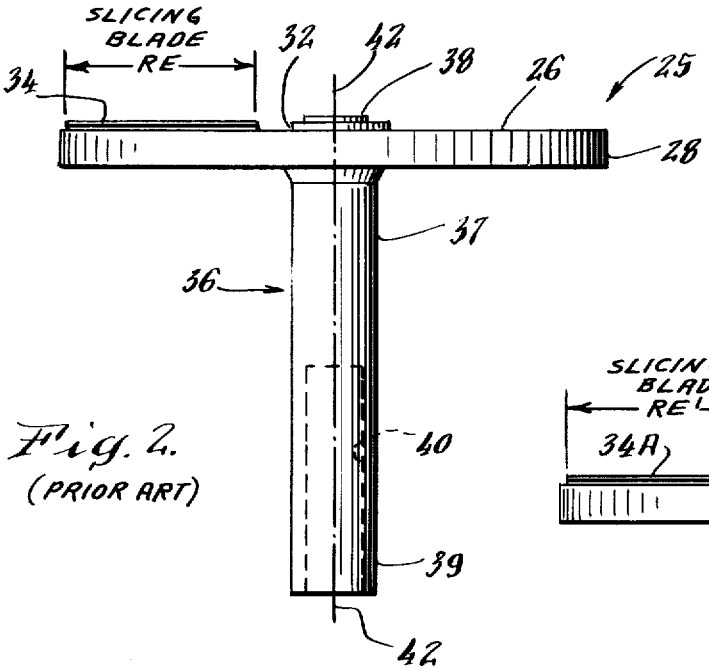
Fig. 2.
(PRIOR ART)
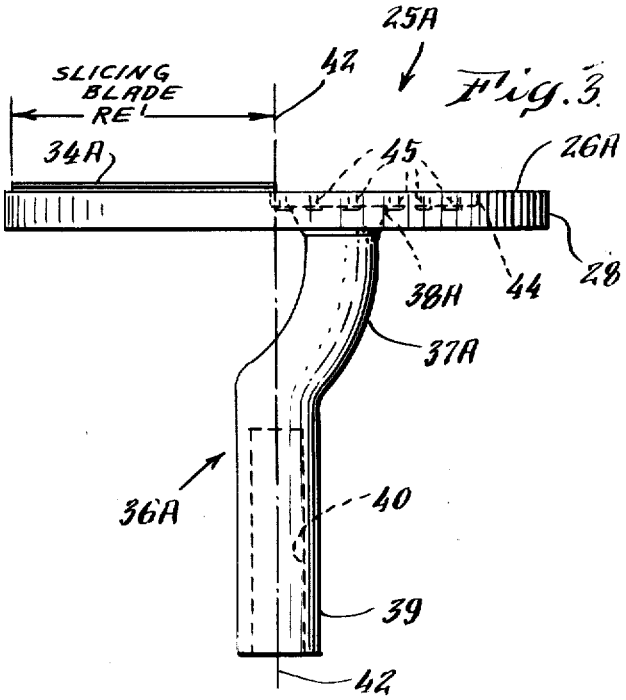
Fig. 3.

ROTARY FOOD PROCESSING TOOL HAVING OFFSET HUB

BACKGROUND OF THE INVENTION

This invention relates to food processors, and more particularly to rotary food cutting tools for food processors having a cutting surface which may extend over a full radius of the tool accommodating the accompanying feed tube which may also extend over the full radius of the tool and thereby permitting the processing of larger food items in food processors which heretofore were limited by the restrictive dimensions caused by the centralized position of the hub head which limited the size of the cutting surface as well as the corresponding radial width of the feed tube.

The present invention is applicable to food processors of the type having a working bowl with a motor-driven tool shaft projecting upwards in the bowl on which various selected rotary food processing tools can be engaged to be driven for performing various food processing operations in accordance with the desires of the user. A detachable cover is secured over the top of the bowl during use. The cover includes a feed tube having a mouth that opens downwardly through the cover into the top of the bowl. The food items to be processed are placed in this feed tube, and then they are manually pushed down through the feed tube into the bowl by means of a removable food pusher which is adapted to slide down in the manner of a plunger through the feed tube. Further information with respect to such food processors may be obtained by reference to U.S. Pat. Nos. 3,892,365—Verdun; 3,985,304—Sontheimer; and 4,127,342—Coggiola.

Of particular interest to the present invention are the rotary cutting tools which are used for slicing, dicing, cutting, grating, etc. of food items such as potatoes, onions, carrots, cucumbers, celery, cabbage, squash, beets, etc. Such rotary cutting tools have a horizontal disc-like member formed of sheet metal, preferably of staniless steel which is mounted on an elongated hub extending down into the bowl of the food processor and which is coupled on the lower end thereof to a motor-driven tool shaft in the food processor. Such prior art rotary cutting tools are mounted to a centralized head or top of the hub such tht the axis of rotation of the motor-driven shaft coincides with the axis of rotation of the hub on the disc-like member. Accordingly, the surface of the cutting edge on such a prior art disc-type tool, whether it be a slicing blade, or other cutting implements, can extend only outside of the centralized hub out to the perimeter of the disc, which restricts such cutting edges to only part of the radius of the disc. Since the length of the cutting surface is restricted by the centralized hub, the radial width of the feed tube must also be restricted to be significantly less than the full radial size of the disc-like tool. Therefore, larger food items having dimensions exceeding the limited radial extent of the cutting surface cannot be conveniently processed.

SUMMARY OF THE PREFERRED EMBODIMENTS OF THE INVENTION

It is an object of the present invention to provide a new and novel rotary food cutting tool with its associated feed tube of larger radial width for accommodating the processing of larger food items than could be conveniently accommodated by prior art food processors.

A further object of this invention is to provide a new and novel rotary food cutting tool which may be utilized with conventional food processors simply by replacing the removable cover with a new cover having a feed tube through the cover of larger radial width capable of accommodating larger food items to be processed.

In carrying out this invention in one illustrative embodiment thereof, a rotary food processing tool is provided for a food processor of the type including a housing containing an electric motor drive, a bowl mountable on the housing for enclosing the rotary tool within the bowl with said tool being rotated within the bowl by the motor drive, and a removable cover locked onto the bowl and having a feed tube mounted thereon forming a passageway for feeding food items through the cover onto the rotating tool and into the bowl. The rotary food processing tool has an elongated hub with a head on one end and coupling means adapted to be coupled to and rotated by the electric motor drive. The head of the hub is offset radially from the coupling means on the hub such that the head of the hub revolves around the axis of rotation of the coupling means on the hub. A horizontal disc-like member is mounted on the head of the hub at a location which is radially offset from the center of the disc-like member. Cutting means are provided on the disc-like member extending from near the center of the disc-like member to the periphery thereof. A feed tube on the cover has a radial width extending from near the axis of rotation of the disc-like member to the periphery of the cover; in other words the radial width of the feed tube may extend from the center of the cover out to the periphery of the cover, thereby accommodating the processing of larger food items. A larger cutting capacity may thereby be provided with a working bowl and disc-like tool of given size.

BRIEF DESCRIPTION OF THE DRAWINGS

The invention, together with further aspects, objects, features and advantages thereof, will be more clearly understood from a consideration of the following detailed description taken in conjunction with the accompanying drawings, in which:

FIG. 1 is a top plan view of a prior art food processor illustrating one type of prior art disc-type rotary slicing tool in the working bowl along with its associated cover and feed tube for directing food items down to the rotating tool.

FIG. 2 is a side elevational view of the prior art rotary slicing tool illustrated in FIG. 1.

FIG. 3 is a side elevational view of a novel disc-type rotary food processing tool having a radially offset hub head and embodying the present invention.

DESCRIPTION OF THE PREFERRED EMBODIMENTS

Figure 4:
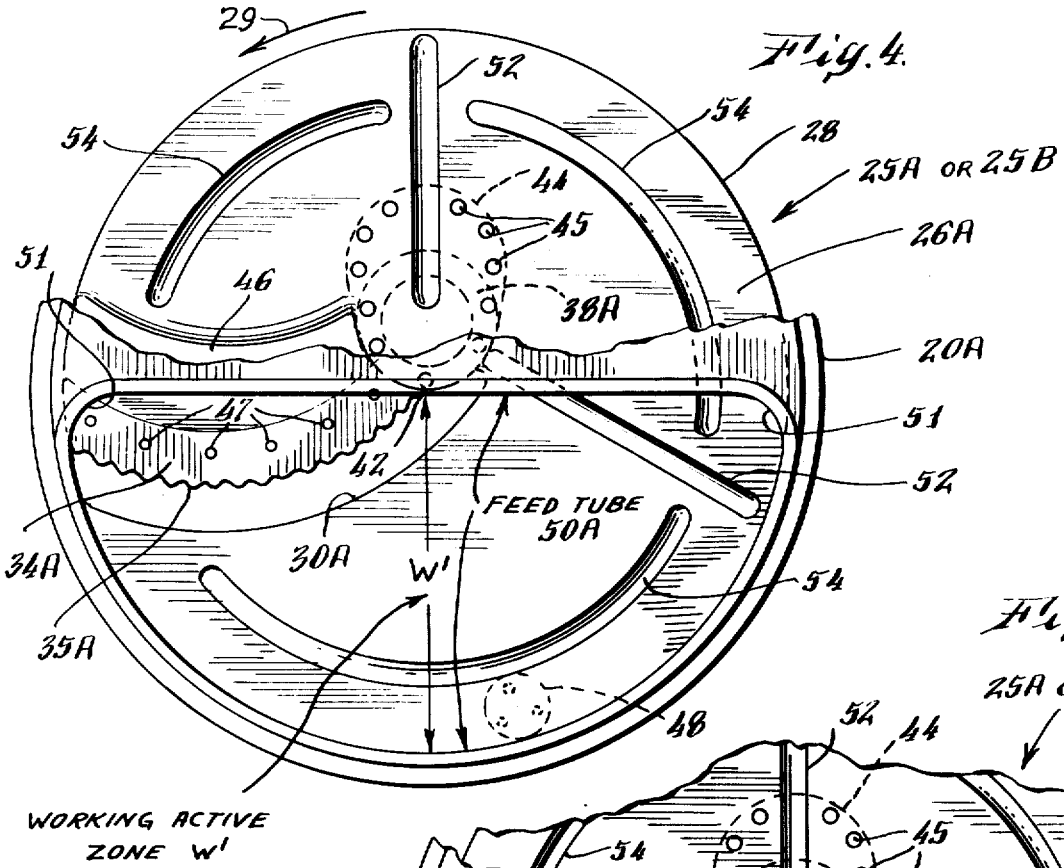
FIG. 4 is a top plan view of the novel disc-type of rotary food processing tool shown on somewhat enlarged scale with an associated cover and with the novel feed tube on the cover, parts of the cover being broken away for clarity of illustration.

In the following description like elements will bear the same reference characters in the various FIGURES while similar elements, which are modified, will bear the same reference characters followed by a letter.

Reference is first made to FIGS. 1 and 2 which illustrate a prior art food processor and rotary food slicing tool referred to generally with the reference characters 10 and 25, respectively. This prior art apparatus is described in some detail herein in order to illustrate clearly by comparison the improved structure and performance of the novel rotary cutting tools and their accompanying feed tubes which embody the present invention. The prior art food processor 10 has a housing 12 which includes an electric drive motor (not shown), a line cord 13 for supplying power to the food processor and a plurality of manual control levers 14. The controls 14 may actuate switches, one of which intermittently activates the food processor in a "jog" or "pulse" mode of operation and one of which may comprise a running switch for producing a normal running mode of operation. The food processor 10 includes a working bowl 15 having a handle 16, and there is a motor-driven tool shaft 18 projecting up into the bowl 15 on which various selected rotary tools can be engaged to be driven by the shaft 18 for performing various food processing operations, such as cutting, slicing, grating, etc. A detachable cover 20, which is secured by locking means 22 in position over the top of the bowl 15 during use, includes a feed tube 50 which has a mouth opening downwardly through the cover 20 into the top of the bowl 15.

One type of prior art rotary cutting tool is illustrated in FIG. 2 in the form of rotary food slicing tool 25 which includes a disc-like member 26 which is formed of sheet metal, preferably stainless steel, having a down-turned flange 28 extending around its perimeter. The disc-like member 26 is mounted on an axially elongated straight hub 36. This elongated hub 36 has a head 38 which is secured to the center of the disc member 26. The hub head 38 is coupled by a straight intermediate shank member 37 to the lower end 39 of the elongated hub. This lower end 39 has a bore or socket 40 serving as hollow coupling means which is adapted to be coupled to the rotating tool shaft 18. Accordingly, the disc-like member 26 is rotated about the axis 42 of the hub 36 which may be molded from rigid, impact resistant plastic material. The disc-like member 26 is molded into the hub head 38 as shown. There is a central opening in the disc member 26, and the plastic hub head 38 extends through this opening, thereby forming a raised central region above the upper surface of the disc member as seen in FIG. 2.

The disc-like member 26 has an arcuate slot 30 formed in the horizontal surface of the disc and extending from a region near the hub head 38 out to the peripheral flange 28. The tool 25 rotates in a counter clockwise direction as shown by the arrow 29, and the trailing edge of the slot 30 is pressed upwardly to form an elevated rim on which an arcuate hardened steel slicing blade 34 is secured by spot welding. This slicing blade projects forwardly partially over and above the open slot 30. The sharpened front edge 35 of the blade 34 may be slightly scalloped or serrated as shown in FIG. 1. In some prior art slicing tools 25 a small portion of the plastic in the hub head 38 is cut away on a chord line 32 on the side where the slicing blade 34 is located.

Food items to be prepared are placed in the feed tube 50 and are pushed down through it into contact with the rotary slicing tool 25 by means of a removable, manually operable food pusher (not shown). This food pusher is adapted to slide down in the manner of a plunger into the feed tube 50 thereby urging the food items into contact with the rotary tool 25. The food pusher is characterized as being slightly smaller than the feed tube 50 but of the same length and with a protruding flange or other protruding stop means at the top which stops the downward movement of the pusher just short of going down into contact with the rotary slicing tool 25. The slices which are cut from the food item pass down through the slot 30 in the disc-like member and fall into the bottom of the bowl 15.

It will be observed from FIGS. 1 and 2 that the size of the food items which may be processed by the food processor are limited by the length of the slicing blade 34 and the radial width of the feed tube 50 both of which are limited by the central position of the hub head 38. This radial width dimension "W" or working active zone, namely the width of the feed tube in the radial direction and the effective radial extent of the cutting surface in a prior art tool 25 are considerably less than the radius of the disc-like member 26. Even if the feed tube were attempted to be made larger in the radial width-direction W, larger food items could not be cleanly processed, because the cuts made would still be limited by the effective radial extent of the cutting surface 35. The excess portions of the food item would not be cleanly sliced and would become smashed or otherwise deformed in a manner which would detract from the performance of the food processor 10.

As an example of the prior art, of a particular widely used rotary slicing tool 25, the disc-like member 26 has a diameter of $5\frac{1}{2}$ inches, or a radius of $2\frac{3}{4}$ inches. The slicing blade has a radial extent RE as seen in FIG. 2 of only 2 inches, thus having a radial extent of only 72.7% of the radius of the disc member 26.

In accordance with the present invention as illustrated in one embodiment thereof in FIGS. 3 and 4, a rotary cutting tool 25A has a slicing disc 26A with its down-turned flange 28 mounted on a radially offset hub head 38A. This hub head 38A is coupled by an intermediate curved shank member 37A to the lower end 39 of the elongated hub 36A which includes the coupling means 40 for mounting on a tool shaft 18 in a working bowl. This coupling means 40 and the lower end 39 rotate about the axis 42 which is the axis of rotation of the tool shaft 18 and corresponds to the central axis of the disc-like member 26A. However, since the hub head 38A is radially offset from the axis 42 by the curved intermediate shank member 37A, the hub head 38A revolves about the axis 42 of the tool shaft 18. This eccentric position of the hub head 38A permits the slicing blade 34A to extend for the full radial extent RE' of the disc-like member 26A from the center of the disc, i.e. from the axis of rotation 42, out to the peripheral flange 28A.

As will best be seen in FIG. 4, outwardly extending and arcuate stiffening ribs 52 and 54, respectively, may be embossed downwardly into the disc-like member 26A to provide additional strength and support therefore.

In order to mount the disc-member 26A into the eccentric hub head 38A, there is a horizontal mounting flange or ledge 44 extending outwardly from the periphery of the hub head, and a plurality of flat-head rivets 45 extend down through the disc member 26A and through this mounting flange 44. The flat heads of the rivets are flush with the top surface of the disc member 26A. The hub head 38A is entirely below the disc member 26A. Thus, advantageously, there are no protrusions extending upwardly above the top surface of the disc member 26A except for the slicing blade 34A and the elevated region 46 of the disc 26A onto the leading portion of which the slicing blade is spot welded as shown at 47.

It is to be noted that the slicing blade 34A and its leading edge 35A extend substantially all of the way inward to the axis of rotation 42. Also, the slot 30A extends inward near the axis 42. Thus the radial extent RE' provided by this novel rotary tool 25A is substantially equal to the full radius of the disc member 26A from the axis of rotation 42 to the rim flange 28.

The hub 38A and its flange 44 may include a groove to accommodate the depressed rib 52. If desired for balance, a small counter weight 48 may be attached by spot welding the disc member 26A near its down-turned flange 28.

The increased radial extent RE' of the cutting blade 34A accommodates the use of a much larger feed tube 50A, for example one having a generally semi-circular configuration as shown in FIG. 4. This semi-circular feed tube 50A extends in one dimension W', which may be called the working active zone, from the center of rotation 42 of the disc-like member 26A out to its peripheral rim 28. The wider feed tube 50A and the longer cutting edge 35A of the blade 34A permit the slicing of much larger food items, such as whole fruits and vegetables which cannot be accommodated by the prior art configuration shown in FIG. 1. The configuration of feed tube 50A in the cover 20A is semi-circular with rounded ends at 51.

Figure 5:
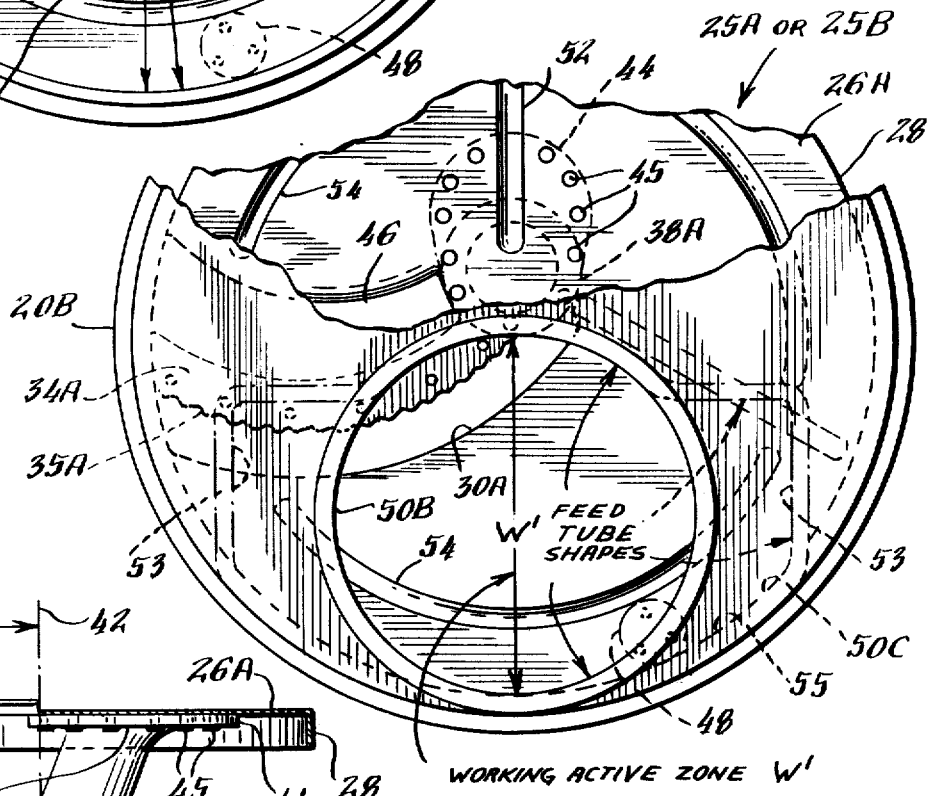
FIG. 5 is a partial top plan view similar to FIG. 4 illustrating alternative shapes of feed tubes which may be employed with a rotary food cutting tool embodying the present invention.

As illustrated in FIG. 5, the longer radial extent RE' of the cutting surface provided by offsetting the hub 38A from the axis of rotation 42 of the shaft 18, which permits this increased length of the cutting surface of the rotary tool 25A, also provides flexibility in shaping of the feed tube. Various configurations of feed tube may be provided by replacing the cover 20B with another cover having a different feed tube shape 50C. A circular feed tube 50B in cover 20B may be utilized with the feed tube having a diameter W' equal to the radius of the disc-like member 26B. Another form of feed tube 50C is illustrated in dashed outline which encloses a circular configuration with an oblong truncated semi-circular configuration having square end walls 53 and an arcuate outer wall 55.

Figure 6:
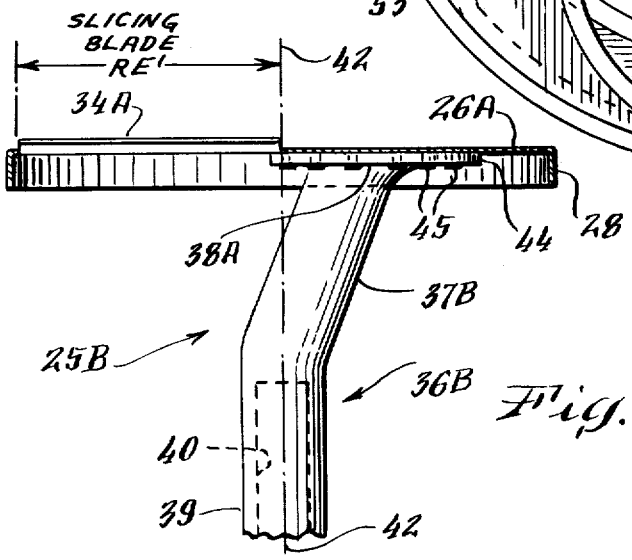
FIG. 6 is a side elevational view of another form of rotary food cutting tool embodying the present invention illustrating the use of an angled hub head for extending the radial extent of the cutting surface on the rotary tool.

FIG. 6 illustrates another embodiment of the novel tool 25B, offsetting the hub head 38A from the axis of rotation 42 of the rotary tool, in order to lengthen the effective radial extent of the cutting surface in accordance with the present invention. In this embodiment the disc-like member 26A is attached by rivets 45 to the mounting flange 44 on the hub head 38A, and the hub head 38A is connected via an inclined intermediate shank member 37B to the coupling end 39 of the elongated hub 36B. The operating results of this configuration 25B are the same as with respect to the rotary cutting tool 25A illustrated in FIG. 3.

It will be understood that in providing the different configurations of feed tubes such as 50A, 50B and 50C, that the food pusher utilized therewith to push the food items into contact with the rotary processing tool will have the same general configuration as that of the feed tube into which they are plunged. Again each plunger will be provided with an upper flange or other stop means so that the food pusher is received in the feed tube when fully plunged therein without striking the rotary processing tool.

Although the rotary processing tool illustrated is a slicing blade it will be understood that the invention is not limited to such a tool and encompasses all disc-type cutting tools in which it is desired to increase the effective radial extent of the cutting surface, in order to process larger food items in accordance with the present invention.

Since other modifications and changes varied to fit particular operating requirements and environments will be apparent to those skilled in the art, the invention is not considered limited to the examples chosen for purposes of illustration and covers all changes in modifications which do not constitute departures from the true spirit and scope of this invention as defined in the appended claims.

I claim:

1. In a food processor of the type including a housing containing an electric motor drive, a bowl mountable on said housing for enclosing a rotary food processing tool within said bowl, said tool being adapted to be rotated within said bowl by said electric motor drive, a removable cover adapted to be secured in position on said bowl, and a feed tube mounted on said cover forming a passageway for feeding food items through said cover into said bowl, the invention comprising:

(a) said rotary food processing tool having an elongated hub with a head on end thereof and a coupling means on the other end thereof adapted to be coupled to and rotated by said electric motor drive, said hub head being radially offset from the axis of rotation of said coupling means such that said hub head revolves around the axis of rotation of said coupling means, (b) a horizontal disc-like cutting member mounted on said offset hub head at a location offset from the center of said horizontal disc-like cutting member, (c) cutting means on said horizontal disc-like member extending from near the center of said disc-like member to the periphery thereof, and (d) said feed tube on said cover being positioned above said disc-like member and having a passageway providing a working active zone extending in the radial dimension with respect to said disc-like member from near the center of said disc-like member to near the periphery thereof.

2. The structure set forth in claim 1 in which said cutting means comprises a slicing blade.

3. The structure set forth in claims 1 or 2 in which said passageway in said feed tube has a semi-circular configuration as seen in top plan view having a radius substantially equal to the radius of said disc-like cutting member.

4. The structure set forth in claims 1 or 2 in which said passageway in said feed tube has a circular configuration as seen in top plan view with a diameter substantially equal to the radius of said disc-like cutting member.

5. A novel rotary food processing tool for a food processor of the type having a working bowl for enclosing a rotary food processing tool and motor drive means which is adapted to rotate a tool within said bowl and a removable cover adapted to be secured in position on said bowl with a feed tube mounted thereon forming a passageway for feeding food items through said cover into said bowl and in which a food pusher can be plunged into said passageway for pushing food items toward the rotary food processing tool, said novel rotary food processing tool comprising:

(a) an elongated hub having an upper head and a lower drive coupling portion adapted to be coupled to and rotated by said motor drive means, (b) said head of said hub being offset radially from the axis of rotation of said lower drive coupling portion, (c) said upper head having a horizontal disc-like cutting member secured thereto for rotation therewith with said head being offset from the center of said horizontal disc-like cutting member, and (d) said disc-like cutting member having a cutting surface which extends from near the center to the periphery thereof, whereby the offset hub accommodates a long effective radial extent of cutting surface, thereby accommodating the cutting of larger food items.

6. The novel rotary food processing tool as set forth in claim 5 in which:

said disc-like cutting member has a horizontal area with a down-turned flange around the perimeter thereof, and said head of said hub is located entirely beneath said horizontal disc-like member.

7. The novel rotary food processing tool as set forth in claim 5 or 6, in which:

said head of the elongated hub is connected to said lower portion of the elongated hub by a curved shank portion.

8. The novel rotary food processing tool as set forth in claim 5 or 6 in which:

said head of the elongated hub is connected to said lower portion of the elongated hub by an inclined shank portion.

9. A novel rotary food processing tool for use in a food processor of the type having a housing with a work bowl mountable on the housing and in which the rotary tool has an elongated hub with a head to which a disc-like member is secured and with a lower end including coupling means removably engageable with the drive means for rotating the tool in the bowl about the axis of rotation of the coupling means:

said novel rotary food processing tool including a head of the elongated hub which is offset radially to one side of the axis of rotation;

a disc-like member which is secured to said hub head at a position offset radially to the same side of the axis of rotation as said head for causing said disc-like member to rotate about its true center in spite of said offset hub; and cutting means on said disc-like member located generally on the opposite side of the axis of rotation from the location of said offset hub head, whereby said cutting means may have an effective radial extent comparable in size with the radius of said disc-like member.

10. A novel rotary food processing tool as claimed in claim 9, in which:

said offset hub head is positioned entirely beneath said disc-like member.

11. A novel rotary food processing tool as claimed in claim 9 or 10, in which:

said elongated hub includes a shank portion which is crooked with respect to the axis of rotation of said coupling means, and said crooked shank portion connects the head of the hub with said coupling means.

12. A novel rotary food processing tool as claimed in claim 9 or 10, for use with a removable cover adapted to be locked in position on the working bowl, said removable cover having a feed tube with a radial width comparable in size with the radius of said disc-like member, thereby to provide a working active zone for the food processor which is substantially equal to the full radius of said disc-like member.

13. A rotary food processing tool for use in the working bowl of a food processor, said tool having a disc-like member and an elongated hub including coupling means adapted to be coupled to tool drive means for rotating the tool, said elongated hub having its head attached to said disc-like member, said rotary tool comprising:

said hub head being attached to said disc-like member at a position which is offset from the center of said disc-like member, an offset shank portion of said elongated hub connecting said offset hub head with a second portion of said elongated hub which includes said coupling means, said second portion of said elongated hub being aligned with the center of said disc-like member for rotation of said disc-like member about an axis of rotation passing through the center of said disc-like member, and cutting means on said disc-like member located generally between the center of said member and its periphery and being located generally on the opposite side of said disc-like member from said offset hub head, whereby said cutting means may have a working active zone comparable in radial extent with the radius of said disc-like member.

14. A rotary food processing tool as claimed in claim 13, in which, said hub head is located entirely below said disc-like member for providing a generally smooth top surface of said disc-like member above said offset hub head.

15. A rotary food processing tool as claimed in claim 13 or 14, in which:

said offset shank portion of said elongated hub is elbow shaped.

16. A rotary food processing tool as claimed in claim 13 or 14, in which:

said offset shank portion of said elongated hub is inclined.

17. In a food processor of the type including tool drive means, a bowl for enclosing a rotatable tool within said bowl, said rotary tool being driveable by said tool drive means, the invention comprising:

said rotatable tool having an axis of rotation with a hub head radially offset from the axis of rotation, said rotatable tool including coupling means for engagement with said drive means, said coupling means being concentric with said axis of rotation, said rotatable tool including a shank connecting said coupling means with said hub head, said shank extending offset from said axis of rotation, said rotatable tool including a disc-like member attached to said offset hub with the center of said disc-like member positioned on said axis of rotation, and cutting means on said disc-like member located generally in the area of said disc-like member on the opposite side from said offset hub.

18. In a food processor of the type set forth in claim 17, and wherein there is a removable cover for said bowl and a feed tube on the cover defining a passageway for feeding food items into said bowl, the invention further comprising:

said feed tube passageway having a width extending in the radial direction relative to said disc-like member from a point near said axis of rotation to a point near the periphery of said disc-like member for defining a working active zone having a radial extent comparable in size with the radius of said disc-like member, thereby enabling the feeding of relatively large food items through said feed tube passageway to said rotary tool.

* * * * *